US006176701B1

(12) United States Patent
Robinson

(10) Patent No.: US 6,176,701 B1
(45) Date of Patent: Jan. 23, 2001

(54) METHOD FOR IMPROVING FUEL EFFICIENCY IN COMBUSTION CHAMBERS

(76) Inventor: Barnett Joel Robinson, 227 California St., Newton, MA (US) 02458

( * ) Notice: Under 35 U.S.C. 154(b), the term of this patent shall be extended for 0 days.

(21) Appl. No.: 09/483,598

(22) Filed: Jan. 14, 2000

Related U.S. Application Data

(63) Continuation-in-part of application No. 08/942,015, filed on Oct. 1, 1997, now abandoned.

(51) Int. Cl.[7] ..... C10L 10/00

(52) U.S. Cl. ..... 431/4; 431/12; 44/321; 44/354; 44/603; 44/640

(58) Field of Search ..... 431/4, 8, 10, 12; 423/213.2, 212, 213.5; 44/354, 258–367, 321, 603, 640

(56) References Cited

U.S. PATENT DOCUMENTS 2,086,775 * 7/1937 Casareto et al. ..... 435/71.1
4,248,720 * 2/1981 Coupland et al. ..... 252/42.7
4,295,816 * 10/1981 Robinson ..... 431/4
4,647,293 * 3/1987 Cahill et al. ..... 44/68
5,085,841 * 2/1992 Robinson ..... 423/213.5
5,258,347 * 11/1993 Khazai et al. ..... 502/306
5,801,020 * 7/1937 Casareto et al. ..... 435/71.1

* cited by examiner

*Primary Examiner*—James C. Yeung
(74) *Attorney, Agent, or Firm*—David M. Warren

(57) ABSTRACT

A method of improving fuel efficiency in combustion chambers, for simultaneously enhancing combustion of hydrocarbon fuels while inhibiting nitrogen oxidation. A mixture of metallic compounds is introduced into the flame zone of a combustion chamber, such that this mixture is held by gases in the flame zone during the combustion of the fuel, and the mixture is thereby ionized prior to or during the combustion. The ionized mixture of compounds contains platinum, rhodium, rhenium, and molybdenum.

7 Claims, No Drawings

METHOD FOR IMPROVING FUEL EFFICIENCY IN COMBUSTION CHAMBERS

RELATED APPLICATION

This application is a continuation-in-part of application Ser. No. 08/942,015 filed Oct. 1, 1997, abandoned.

FIELD OF THE INVENTION

The present invention generally relates to a method of improving fuel efficiency in combustion chambers. More specifically, the present invention relates to a method of improving fuel efficiency in combustion chambers (by enhancing carbon or hydrogen combustion while simultaneously inhibiting nitrogen oxidation), comprising introducing a mixture of metallic compounds into the flame zone of a combustion chamber substantially homogeneously, such that the mixture is held by gases in the flame zone during the combustion of the fuel, and the mixture is thereby ionized prior to or during the combustion. This ionized mixture of compounds contains platinum, rhodium, rhenium, and molybdenum.

BACKGROUND OF THE INVENTION

The burning of almost all hydrocarbon fuels in their respective combustion chambers is almost never complete. There are many hazardous byproducts commonly produced when fuel in combustion chambers is inefficiently burnt. These byproducts may include hydrocarbons, soot, smoke, carbon monoxide (CO), and oxides of nitrogen ($NO_x$). The unburned and partially burned fuel represent both pollution of the combustion process and a financial loss to the purchaser of the fuel. The only pollutant from a combustion process which is not unburned or partially burned fuel is nitrogen oxide. However, since the oxidation of the nitrogen to form nitrogen oxide is endothermic, the inhibiting of the oxidation of nitrogen is also equivalent to the burning of less fuel.

A second problem related to actual combustion chambers, such as in automotive engines or in oil fired boilers, is that these chambers have a wide distribution of parametric variation. This has been experimentally verified (by the inventor of the method of the present invention) by measuring the fuel combustion efficiency of new automobiles of the same model and of almost identical dates of manufacture.

Effective methods for simultaneously enhancing fuel oxidation and inhibiting nitrogen oxidation are known (i.e. 1992 U.S. Pat. No. 5,085,841—by the inventor of the present invention). However, because of the parametric variations of actual engines, these methods often fail to provide beneficial results in a percentage of individual engines. The method of the present invention is a substantial improvement over the prior arts, in that all individual engines measured have shown significant improvements of increased fuel oxidation and of decreased nitrogen oxidation.

SUMMARY OF THE INVENTION

The present invention relates to a method of improving fuel efficiency in combustion chambers by simultaneously enhancing combustion of carbon or hydrogen while inhibiting oxidation of nitrogen. It is believed that the invention is operative by catalyzing the oxidation of hydrogen, carbon, and carbon monoxide which are present during the combustion of typical automotive fuels, while simultaneously inhibiting the oxidation of nitrogen. This method is comprised of introducing a mixture of metallic compounds into the flame zone of a combustion chamber substantially homogeneously, such that the mixture is held by gases in the flame zone during the combustion of the fuel, and the mixture is thereby ionized prior to or during the combustion. The ionized mixture of compounds according to the present invention contains platinum, rhodium, rhenium, and molybdenum.

DETAILED DESCRIPTION OF THE INVENTION

For the purpose of the present invention, a "fuel" is any substance which is exothermically oxidized in a combustion chamber. Furthermore, a fuel generally relates to compounds of carbon and/or compounds of hydrogen, as well as to carbon and hydrogen themselves.

For purposes of the present invention, "metallic compounds" relate to compounds containing constituent metals which ionize under the physical conditions (e.g. pressure, temperature) found in combustion chambers during the fuel combustion process. For purposes of the present invention, there are many practical metallic compounds (for any specific metal) which contribute to providing the desired results when introduced into a combustion chamber. Examples of such compounds may typically be chosen from the chlorides, oxides, hydroxides, and hydrates of the metals platinum, rhodium, rhenium, and molybdenum.

The present invention relates to a method of improving fuel efficiency in combustion chambers, for simultaneously enhancing fuel (carbon or hydrogen) combustion while inhibiting nitrogen oxidation. This method is comprised of introducing a mixture of metallic compounds into the flame zone of a combustion chamber (so that these compounds are distributed within the combustion chamber) substantially homogeneously, such that the mixture is held by gases in the flame zone during the combustion of the fuel, and the mixture is thereby ionized prior to or during the combustion. The ionized mixture of compounds contains platinum, rhodium, rhenium, and molybdenum.

According to one embodiment of the method of the present invention, the mixture of compounds contains from 0.15 to 225 mcg (micrograms) platinum, from 0.045 to 67.5 mcg rhodium, from 0.07 to 105.0 mcg rhenium, and from 1.16 to 174.0 mcg molybdenum per kilogram of fuel.

According to the preferred embodiment of the method of the present invention, the mixture of compounds contains about 15.0 mcg platinum about 4.5 mcg rhodium, about 7.0 mcg rhenium, and about 11.6 mcg molybdenum per kilogram of fuel. Near optimum combustion benefits are obtained within the range of about 10–20 mcg platinum, about 3–6 mcg rhodium, about 4–10 mcg rhenium, and about 7–16 mcg molybdenum per kilogram of fuel. Good benefits are obtained even within the larger range of about 8–24 mcg platinum, about 2–8 mcg rhodium, about 3–10 mcg rhenium, and about 6–18 mcg molybdenum per kilogram of fuel.

According to the preferred embodiment of the method of the present invention, the molybdenum compound is hexaamoniumheptamolybdate tetrahydrate ($(NH_4)_6Mo_7O_{24}.4H_2O$). This compound is commonly called "AHM". Note, there is no measurable improvement using only "AHM" (the preferred molybdenum compound) without the Pt, Rh, and Re compounds mixture (of the 1992 patent).

The mixture of metallic compounds (or any component thereof) is introduced into the combustion chamber through one or more pathways. According to the preferred embodiment of the method of the present invention, the mixture of compounds is introduced into the combustion chamber by air flow. According to other embodiments of the method of the present invention the mixture of compounds is introduced into the combustion chamber by a stream of fuel, or the mixture of compounds is introduced into the combustion chamber by a vaporous mixture of fuel and air. Furthermore, according to other variations of the method of the present invention, the components of the mixture of compounds may be introduced into the combustion chamber by using more than one pathway. For example, the four components (of the mixture of compounds) may be divided such that two of the components are introduced through the air flow with the other two components being introduced with the fuel.

According to any embodiment of the method of the present invention whereby the mixture of compounds is introduced into the combustion chamber, there are about 15 parts platinum, about 4.5 parts rhodium, about 7.0 parts rhenium, and about 11.6 parts molybdenum by mass ratio, per kilogram of fuel, in the chamber during a combustion of fuel in the chamber.

The present invention will be further described and clarified in detail by Tables 1–2. These Tables are solely intended to illustrate the preferred embodiment of the invention and are not intended to limit the scope of the invention in any manner.

TABLE 1

| | HIGHWAY DRIVING Km/liter* (% improvement) | | | |
|---|---|---|---|---|
| Vehicle Description | Km/liter NO Treat-ment | Km/liter WITH Pt, Rh, Re (1992 Patent) | Km/liter WITH Pt, Rh, Re, Mo (Present Invention) | % IMPROVE-MENT of Present Invention over 1992 Patent |
| 1990 Chrysler 3.3 liter V-8 | 6.8 | 7.2 (5.9%) | 8.3 (22.1%) | 15.3% |
| 1995 GMC 1500 5.7 liter V-8 | 5.3 | 5.5 (3.8%) | 6.5 (22.6%) | 18.2% |
| 1991 Toyota M.H. 3.0 liter V-6 | 3.6 | 4.1 (13.9%) | 4.3 (19.4%) | 4.9% |
| 1990 Mitsubishi 4WD 3.0 liter V-6 | 5.4 | 5.9 (9.3%) | 6.4 (18.5%) | 8.5% |
| 1996 Hyundai 1.5 liter 4-cyl. | 10.2 | 11.7 (14.7%) | 12.2 (19.6%) | 4.3% |
| 1994 Honda Accord 2.2 liter 16 V 4-cyl. | 10.2 | 10.9 (6.9%) | 11.4 (11.8%) | 4.6% |
| AVERAGE | 6.9 | 7.6 (10.1%) | 8.2 (18.8%) | 7.9% |

Note:
THERE WAS NO MEASURABLE IMPROVEMENT using "AHM" (the preferred Molybdenum compound) WITHOUT the Pt, Rh, and Re compounds mixture (of the 1992 patent).
*To determine miles per gallon, multiply Km/liter by 2.35. For example, 10 Km/liter = 23.5 Miles/gallon.

TABLE 2

| | CITY DRIVING Km/liter* (% improvement) | | | |
|---|---|---|---|---|
| Vehicle Description | Km/liter NO Treat-ment | Km/liter WITH Pt, Rh, Re (1992 Patent) | Km/liter WITH Pt, Rh, Re, Mo (Present Invention) | % IMPROVE-MENT of Present Invention over 1992 Patent |
| 1990 Chrysler 3.3 liter V-8 | 8.1 | 8.9 (9.9%) | 10.1 (24.7%) | 13.5% |
| 1995 GMC 1500 5.7 liter V-8 | 6.8 | 7.2 (5.9%) | 9.7 (42.6%) | 34.7% |
| 1991 Toyota M.H. 3.0 liter V-6 | 4.3 | 5.3 (23.3%) | 5.7 (32.6%) | 7.5% |
| 1990 Mitsubishi 4WD 3.0 liter V-6 | 6.4 | 7.0 (9.4%) | 9.5 (48.4%) | 35.7% |
| 1996 Hyundai 1.5 liter 4-cyl. | 12.8 | 13.5 (5.5%) | 14.8 (15.6%) | 9.6% |
| 1994 Honda Accord 2.2 liter 16 V 4-cyl. | 12.6 | 13.1 (4.0%) | 14.8 (17.5%) | 13.0% |
| AVERAGE | 8.5 | 9.2 (7.9%) | 10.8 (27.1%) | 17.4% |

Note:
THERE WAS NO MEASURABLE IMPROVEMENT using "AHM" (the Preferred Molybdenum compound) WITHOUT the Pt, Rh, and Re compounds mixture (of the 1992 patent).
*To determine miles per gallon, multiply Km/liter by 2.35. For example, 10 Km/liter = 23.5 Miles/gallon.

Table 1 is a chart showing experimental results for city driving on six specific automotive vehicles.

Table 2 is a chart showing experimental results for highway driving on six specific automotive vehicles.

With respect to Table 1, shown here are the test results under conditions of "no treatment", using a treatment of "Pt, Rh, and Re compounds (as described in the 1992 Patent), and using the mixture of metallic compounds according to the method of the present invention.

These results are presented as kilometers per liter for each category, and also as a percent improvement over "no treatment" (shown in parentheses). Furthermore, the results have been summarized as an average of the six vehicles. For city driving (on average), the method of the present invention provides about 7.9% better fuel efficiency improvement than the 1992 patent's method.

With respect to Table 2, shown here are the test results under conditions of "no treatment", using a treatment of "Pt, Rh, and Re" compounds (as described in the 1992 Patent), and using the mixture of metallic compounds according to the method of the present invention.

These results are presented as kilometers per liter for each category, and also as a percent improvement over "no treatment" (shown in parentheses), as well as the improvement by percent of the present invention over the 1992 patent. Furthermore, the results have been summarized as an average of the six vehicles. For highway driving (on average), the method of the present invention provides about 17.4% better fuel efficiency improvement than the 1992 patent's method.

I claim:

1. A method of improving fuel efficiency in combustion chambers for simultaneously enhancing the combustion of hydrocarbon fuels while inhibiting nitrogen oxidation comprising introducing a mixture of metallic compounds via a vaporous transport into the flame zone of a combustion chamber substantially homogeneously, such that said mixture is held by gases in the flame zone during the combustion of the fuel, and the mixture is thereby ionized prior to or during said combustion, and the ionized mixture of compounds contains about 15 micrograms of platinum, about 4.5 micrograms of rhodium, about 7.0 micrograms of rhenium, and about 11.6 micrograms of molybdenum per kilogram of fuel.

2. A method according to claim 1, wherein the mixture of compounds is introduced into the combustion chamber through the air flow fed into the combustion chamber.

3. A method according to claim 1, wherein the mixture of compounds is introduced into the combustion chamber through the stream of fuel fed into the combustion chamber.

4. A method according to claim 1, wherein the mixture of compounds is introduced into the combustion chamber through a mixture of fuel and air fed into the combustion chamber.

5. A method according to claim 1 wherein the molybdenum compound is hexaamoniumheptamolybdate tetrahydrate ($(NH_4)_6Mo_7O_{24}.4H_2O$).

6. A method of improving fuel efficiency in combustion chambers for simultaneously enhancing the combustion of hydrocarbon fuels while inhibiting nitrogen oxidation comprising introducing a mixture of metallic compounds via a vaporous transport into the flame zone of a combustion chamber substantially homogeneously, such that said mixture is held by gases in the flame zone during the combustion of the fuel, and the mixture is thereby ionized prior to or during said combustion, and the ionized mixture of compounds contains about 10–20 micrograms of platinum, about 3–6 micrograms of rhodium, about 4–10 micrograms of rhenium, and about 7–16 micrograms of molybdenum per kilogram of fuel.

7. A method of improving fuel efficiency in combustion chambers for simultaneously enhancing the combustion of hydrocarbon fuels while inhibiting nitrogen oxidation comprising introducing a mixture of metallic compounds via a vaporous transport into the flame zone of a combustion chamber substantially homogeneously, such that said mixture is held by gases in the flame zone during the combustion of the fuel, and the mixture is thereby ionized prior to or during said combustion, and the ionized mixture of compounds contains about 8–24 micrograms of platinum, about 2–8 micrograms of rhodium, about 3–10 micrograms of rhenium, and about 6–18 micrograms of molybdenum per kilogram of fuel.

* * * * *